United States Patent [19]

Yamato et al.

[11] Patent Number: 4,498,091

[45] Date of Patent: Feb. 5, 1985

[54] HEAT-SENSITIVE RECORDING SHEET

[75] Inventors: Noboru Yamato; Toshimi Satake; Toshiaki Minami; Fumio Fujimura, all of Tokyo, Japan

[73] Assignee: Jujo Paper Co., Ltd., Tokyo, Japan

[21] Appl. No.: 590,199

[22] Filed: Mar. 15, 1984

[30] Foreign Application Priority Data

Mar. 15, 1983 [JP] Japan ..... 58-41436

[51] Int. Cl.[3] ..... B41M 5/18

[52] U.S. Cl. ..... 346/216; 346/225; 427/150

[58] Field of Search ..... 346/216, 217, 225; 427/150, 151, 152, 153; 106/14.5, 21

[56] References Cited

U.S. PATENT DOCUMENTS 3,911,171 10/1975 Janssens et al. ..... 427/145

3,965,282 6/1976 Janssens et al. ..... 346/216

*Primary Examiner*—Bruce H. Hess

*Attorney, Agent, or Firm*—Koda and Androlia

[57] ABSTRACT

It has been found that phthalic acid monoester represented by the general formula:

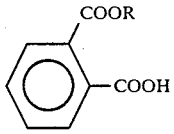

in which R is a saturated alkyl group of 4 to 20 carbon atoms

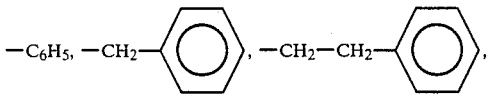

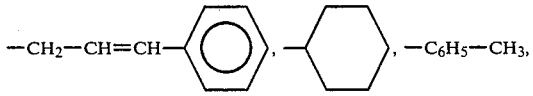

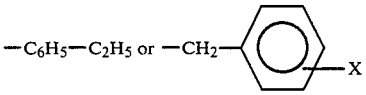

where X is an alkyl group, a halogen or an alkoxy group, is applicable as color-developing agent to prepare heat-sensitive recording sheet with excellent results. It is observed that one of the two carboxylic acid groups of which phthalic acid is composed is esterified with the group mentioned in the claim to form water-insoluble, insublimable compound having melting point of 90° to 130° C. wherein the group introduced controls the acidity of the adjacent carboxylic acid group into a condition suitable for stable and concentrated color-development of colorless dye.

6 Claims, No Drawings

HEAT-SENSITIVE RECORDING SHEET

BACKGROUND OF THE INVENTION

1. Field of the Invention

The present invention relates to a heat-sensitive recording sheet having excellent color-forming properties and stability of background brightness.

2. Prior Art

In general, heat-sensitive recording sheet is produced by applying on the paper surface the coating which is prepared by individually grinding and dispersing a colorless chromogenic dyestuff and a color-developing material, such as a phenolic substance, into fine particles, mixing the resultant dispersions with each other and then adding thereto binder, filler, sensitizer, slipping agent and other auxiliaries. When this sheet is heated, the coating undergoes instantaneously a chemical reaction which forms a color. In this case various bright colors can be advantageously formed depending upon selection of specific colorless chromogenic dyestuff.

As the heat-sensitive recording system is widely adopted and its applications are diversified, high speed recording and the improvement of image, that is, the improvement or resolution, have come to be required. Hence, the heat energy of the thermal heads in the recording equipment capable of such high density and such high speed is more minimized. Therefore, it is required that the heat-sensitive recording sheet have a higher color-forming sensitivity sufficient for producing clear chromogenic records with such small heat input from the thermal head.

On the other hand, there are many color-developing agents which were disclosed in the Japanese Patent Publication No. 14039/1970 and various literatures. Particularly, 4,4'-isopropylidendiphenol (bisphenol A) is now widely put into practical use, since it is stable, inexpensive and readily available. But 4,4'-isopropylidendiphenol has as its disadvantage a high heat color-forming temperature, so that recording-aptitude for a slight amount of heat energy is not adequate and the problems, such as sticking, etc., occurs easily.

The color-forming temperature of heat-sensitive recording sheets depends upon the melting of either one of color-forming materials composed of a chromogenic dyestuff and an acidic material, such as organic acids and phenols.

Where both color-forming materials have a higher melting point, a substance with a lower melting point is added thereto. In this case, if one of the color-forming materials is dissolved by melting this substance, it is possible to cause a color-forming reaction even at a lower temperature. Also, the Japanese Laid-Open Patent Applications Nos. 39139/1978, 26139/1978, 5636/1978, 11036/1978, etc. have proposed to add the following heat-meltable substances of a lower melting point as sensitizers or melting-point-depression-agents: various waxes, fatty acid amides, alkylated biphenyls, substituted biphenylalkanes, cumarin compounds, diphenylamines, etc.

In the method for addition of sensitizer, it is required to melt the sensitizer prior to the color-forming reaction, so that the thermal response for a slight amount of heat energy in short time-pulse cannot be obtained satisfactorily in the high speed dynamic recording. The following problems occur due to the liquidation of the meltable substance in the color-forming layer: adhesion of residues onto the thermal head, bleeding, smearing, ghost, etc. In this case, under storage conditions at high temperature and at high humidity, the coloring of the background occurs with the time elapsed and the contrast of the recording image may be often degraded. Also sufficient results are not always obtained by these methods.

SUMMARY OF THE INVENTION

It is the first object of the present invention to provide a heat-sensitive sheet which produces particularly intense, clear image in high speed and high density recording owing to excellent thermal response.

It is the second object of the present invention to provide a heat-sensitive recording sheet which has high brightness and less decline of brightness in the time elapsed.

It is the third object of the present invention to provide a heat-sensitive recording sheet which is an excellent thermal copying paper for infrared type or stroboflash type thermal copy-machines, in coating thin paper or film.

It is the forth object of the present invention to provide a heat-sensitive recording sheet in which decreased amount of coating is possible and production efficiency is increased.

The above and other related objects can be accomplished by using in a color-forming layer a color-developing agent comprising phthalic acid monoester of the general formula:

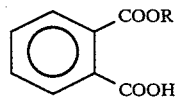

in which R is a saturated alkyl group of 4 to 20 carbon atoms,

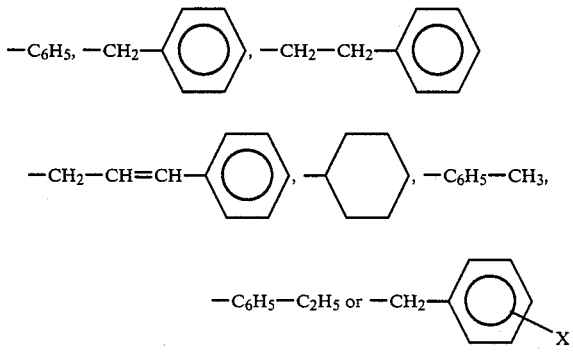

where X is an alkyl group, a halogen or an alkoxy group.

DETAILED DESCRIPTION OF THE INVENTION

Phenol compound such as bisphenol A mentioned above and p-hydroxybenzoic acid ester have been used as color-developing agent for heat-sensitive recording sheet. Other organic carboxylic acids are also exemplified as color-developing agent in Japanese Patent Publication No. 4160/1968 and Japanese Laid-Open Patent Application No. 39139/1978, which, however, have not yet been put to practical use because of their deficient color-developing ability and of their unstable brightness of back-ground.

The phthalic acid monoesters used in this invention have much better color developing ability and stability of the back-ground brightness than the well-known organic carboxylic acids among many of them.

The reason why such excellent effects are obtained is probably that one of the two carboxylic acid groups of which phthalic acid is composed is esterified with the group mentioned in the claim to form water-insoluble, insublimable compound having melting point of 90° to 130° C. wherein the group introduced controls the acidity of the adjacent carboxylic acid group into a condition suitable for stable and concentrated color-development of colorless dye.

Phthalic acid monoesters used in this invention may be phthalic acid monophenylester, phthalic acid monobenzylester, phthalic acid monocyclohexylester, phthalic acid monomethylphenylester, phthalic acid monoethylphenylester, phthalic acid monoalkylbenzylester, phthalic acid monohalogenbenzylester and phthalic and monoalkoxybenzylester and the like.

Phthalic acid monoesters of the present invention may be employed as the color-developing agent of a heat-sensitive recording sheet singly or together with organic carboxylic acids or phenolic substance, such as bisphenol A (4,4'-isopropylidene diphenol, p,p'-(1-methyl-normalhexylidene diphenol, p-tertiary butylphenol, p-phenylphenol, p-hydroxybenzoic acid ester, Novolak phenolic resin, 4-hydroxy-1-methylsulfonylbenzene, 4-hydroxy-1-butyloxysulfonylbenzene, and the like.

The colorless or pale colored dyestuffs of the present invention are not particularly limited and are, for example, as follows: 3-diethyl-amino-6-methyl-7-anilinofluoran (black), 3-(n-ethyl-p-toluidino)-6-methyl-7-anilinofluoran (black), 3-(n-ethyl-n-isoanyl)-amino-6-methyl-7-anilinofluoran (black), 3-diethylamino-6-methyl-7-(o-,p-dimethylanilino)-fluoran (black), 3-pyrrolidino-6-methyl-7-anilinofluoran (black), 3-piperidino-6-methyl-7-anilinofluoran (black), 3-(n-cyclohexyl-n-methylamino)-6-methyl-7-anilinofluoran (black), 3-diethylamino-7-(metha-trifluoro-methylanilino)-fluoran (black), 3-dibutylamino-7-(orthochloroanilino)-fluoran (black), 3-diethylamino-6-methylchlorofluoran (red), 3-diethylamino-6-methyl-fluoran (red), 3-cyclohexylamino-6-chlorofluoran (orange), crystal violet lactone (blue), 3-(4-diethylamino-2-ethoxyphenyl)-3-(1-ethyl-2-methylindol-3-yl)4-azaphthalide (blue), and 3-(4-diethylamino-2-ethoxyphenyl)-3-(1-ethyl-2-methylindol-3-yl)-7-azaphthalide.

The aforementioned color-developing materials and colorless chromogenic dyestuffs are ground down to a particle size of several microns or smaller by means of a grinder or emulsifier such as ball mill, attritor, sand grinder, etc. and in accordance with the purpose, various additives are added thereto to prepare coating colors. Such additives are as follows: binders such as polyvinyl alcohol, modified polyvinyl alcohol, hydroxyethyl cellulose, methyl cellulose, starches, styrene-maleic anhydride copolymer, vinylacetate-maleic anhydride-copolymer, styrene-butadiene-copolymer, etc.; inorganic or organic fillers such as kaolin, calcined kaolin, diatomaceous earth, talc, titanium dioxide, aluminium hydroxide, etc.; if desired, releasing agent such as metal salts of fatty acids, etc.; slipping agents such as waxes, etc.; UV-absorbers of benzophenone type or triazole type; water-resistance-agents such as glyoxal, etc.; dispersants; antifoamers; etc.

The heat-sensitive recording sheet suitable for the purpose can be obtained by applying paper or various films with these coating colors.

The species and the amount of p-hydroxybenzoic acid ester and the amount of other ingredients to be incorporated in accordance with the present invention are not otherwise limited, but determined depending upon the performance and recording aptitude required for the specific heat-sensitive recording sheet. However, in ordinary cases, it is suitable to use 3–10 parts by weight of phthalic acid monoester, and 1–20 parts by weight of filler per 1 part by weight of a chromogenic dyestuff, and to add 10–20% by weight of a binder per total solid content.

Hereinafter, the present invention will be described further by typical exemplary formulation of the preferred embodiments thereof and by reference examples.

EXAMPLE 1

| | |
|---|---|
| Solution A (dispersion of dyestuff) | |
| 3-diethylamino-6-methyl-7-anilinofluoran | 2.0 parts |
| 10% aqueous solution of polyvinyl alcohol | 4.6 parts |
| Water | 2.5 parts |
| Solution B (dispersion of color-developing agent) | |
| Color-developing agent *(see Table 1) | 6.0 parts |
| Zinc stearate | 0.5 parts |
| 10% aqueous solution of polyvinyl alcohol | 30 parts |

The solutions A and B of the above-mentioned composition were individually ground to a particle size of 3 microns by a ball mill. Then, the dispersions were mixed in the following proportion to prepare the coating colors:

| | |
|---|---|
| Solution A (dispersion of dyestuff) | 9.1 parts |
| Solution B (dispersion of color-developing agent) | 36.5 parts |
| Kaolin clay (50% aqueous dispersion) | 12 parts |

The coating colors were applied on one side of the base paper weighing 50 g/m$^2$ at a coating weight of 6.0 g/m$^2$, and were then dried.

The resultant sheets were treated to a smoothness of 200–300 sec. by a supercalender.

The obtained black-color-forming heat-sensitive recording sheets were tested for their quality and performance, and the test results are shown in Table 1.

TABLE 1

| | Color developing agent | Background (1) | | Image density | |
|---|---|---|---|---|---|
| | | Immediately | After a week | (2) static | (3) Dynamic |
| Example | | | | | |
| 1-a | Phthalic acid monobenzyl ester | 0.05 | 0.06 | 1.20 | 1.10 |
| 1-b | Phthalic acid monophenyl ester | 0.06 | 0.07 | 1.14 | 1.01 |
| 1-c | Phthalic acid monomethyl-phenyl ester | 0.06 | 0.07 | 1.10 | 1.00 |
| 1-d | Phthalic acid monomethyl-benzyl ester | 0.06 | 0.08 | 1.13 | 1.02 |
| Reference example | | | | | |

TABLE 1-continued

| | Color developing agent | Background (1) Immediately | Background (1) After a week | Image density (2) static | Image density (3) Dynamic |
|---|---|---|---|---|---|
| 1-a | Bisphenol A | 0.08 | 0.11 | 0.29 | 0.60 |

Notes:
(1) Optical density of background was measured by a Macbeth densitometer RD-104 (lower optical density shows higher brightness).
(2) The heat-sensitive recording sheets were pressed down for 5 seconds under pressure of 10 g/cm$^2$ on a hot plate heated at 105° C. and optical density of statically developed image was measured by a Macbeth densitometer RD-104 (higher optical density shows darker color).
(3) The heat-sensitive recording sheets were recorded in a pulse width of 0.7 milliseconds under the condition of G III-mode by using the thermal facsimile CP-4800 manufactured by TOSHIBA CORPORATION and optical density of recorded image was measured by a Macbeth densitometer RD-104.

As obviously seen from Table 1, the heat-sensitive recording sheets 1-a, 1-d of the Example according to the present invention provide higher brightness of background and less decline of brightness in elapsed time, as compared with the Reference Example 1-e using bisphenol A and have higher dynamic image density in the high speed recording by facsimile. Particularly, effects of using phthalic acid monobenzyl ester are prominent.

EXAMPLE 2

| | |
|---|---|
| Solution A (Dispersion of dyestuff) | |
| 3-(n-cyclohexyl-n-methylamino)-6-methyl-7-anilinofluoran | 2.0 parts |
| 10% aqueous solution of hydroxyethylcellulose | 4.6 parts |
| Water | 2.5 parts |
| Solution B (1) (Dispersion of color-developing agent) | |
| Phthalic acid monobenzyl ester | 6.0 parts |
| Zinc stearate | 0.5 parts |
| 10% aqueous solution of polyvinyl alcohol | 30 parts |
| Solution B (2) (Dispersion of color-developing agent) | |
| Bisphenol A | 6.0 parts |
| Stearic acid amide | 3.0 parts |
| 10% aqueous solution of polyvinyl alcohol | 40 parts |

Each above-mentioned solution was individually ground to a particle size of 3 microns by means of an attritor, and the dispersions were mixed in the hereinafter mentioned proportion to prepare coating colors. Heat-sensitive recording sheets were obtained as in Example 1.

| | | Example 2 | Reference Example 2 |
|---|---|---|---|
| Coating color | Solution A | 9.1 parts | 9.1 parts |
| | Solution B | (1) 36.5 parts | (2) 49.0 parts |
| | Aluminium hydroxide (50% aqueous dispersion) | 10 parts | 10 parts |
| Coating weight | | 5.0 g/m$^2$ | 5.8 g/m$^2$ |

The resultant black-color-forming heat-sensitive recording sheets were tested for their quality and performance as in Example 1, and the test results are shown in Table 2.

TABLE 2

| | Background Immediately | Background (1) Storage at high temperature | Static image density | (2) Dynamic image density |
|---|---|---|---|---|
| Example 2 | 0.05 | 0.07 | 1.30 | 1.21 |

TABLE 2-continued

| | Background Immediately | Background (1) Storage at high temperature | Static image density | (2) Dynamic image density |
|---|---|---|---|---|
| Reference Example 2 | 0.08 | 0.14 | 1.14 | 0.39 |

Notes:
(1) The heat-sensitive recording sheets were treated for 24 hours under 40° C. and 90% R.H., and the optical density of background was measured by a Macbeth densitometer RD-104.
(2) The heat-sensitive recording sheets were recorded by using a thermal facsimile (FR-H type) manufactured by "Matsushita Graphic Communication Systems, Inc.", with a pulse width of 1.0 milli-sec. and an impressed voltage of 17.66 V, and the recorded image density was measured by a Macbeth densitometer RD-104.

As obviously seen from Table 2, Example 2 of the present invention provided higher brightness of background and more excellent preservability under high humidity in comparison with the Reference Example 2 using a combination of bisphenol A and sensitizer.

Further, the heat-sensitive sheet of the present invention has remarkably higher image density under high speed recording by facsimile.

We claim:

1. Heat-sensitive recording sheet having a color-forming layer comprising (1) a colorless or pale colored chromogenic dyestuff and (2) a color developing material which is a phthalic acid monoester of the general formula:

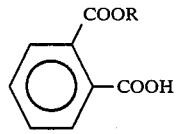

in which R is a saturated alkyl group of 4 to 20 carbon atoms,

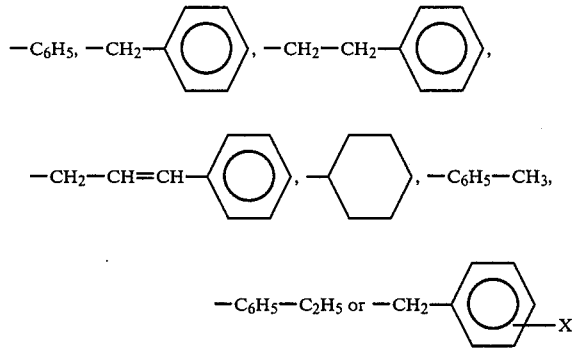

where X is an alkyl group, a halogen or an alkoxy group.

2. Heat-sensitive recording sheet according to claim 1, wherein said phthalic acid monoester is selected from the group consisting of phthalic acid monophenylester, phthalic acid monobenzylester, phthalic acid monocyclohexylester, phthalic acid monomethylphenylester, phthalic acid monoethylphenylester phthalic acid monoalkylbenzylester, phthalic acid monohalogenbenzylester and phthalic and monoalkyoxybenzylester.

3. Heat-sensitive recording sheet according to claim 2, wherein said phthalic acid monoester is phthalic acid monobenzyl ester.

4. Heat-sensitive recording sheet according to claim 1, wherein said phthalic acid monoester is used together with organic carboxylic acids.

5. Heat-sensitive recording sheet according to claim 1, wherein said phthalic acid monoester is used together with phenolic substance.

6. Heat sensitive recording sheet according to claim 5, wherein said phenolic substance selected from the group consisting of bisphenol A (4,4'-isopropylidene diphenol, p,p'-(1-methyl-normalhexylidene diphenol, p-tertiary butylphenol, p-phenylphenol, p-hydroxybenzoic acid ester, Novolak phenolic resin, 4-hydroxy-1-methylsulfonylbenzene, and 4-hydroxy-1-butyloxysulfonylbenzene.

* * * * *